US010304310B2

(12) United States Patent
Ten Kate et al.

(10) Patent No.: US 10,304,310 B2
(45) Date of Patent: May 28, 2019

(54) CHECK-IN SERVICE ON A PERSONAL HELP BUTTON

(71) Applicant: KONINKLIJKE PHILIPS N.V., Eindhoven (NL)

(72) Inventors: Warner Rudolph Theophile Ten Kate, Waalre (NL); Tine Smits, Beerse (NL); Michael Bellomo, Cambridge, MA (US); Andrea Ryter, Sharon, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/747,673

(22) PCT Filed: Jul. 26, 2016

(86) PCT No.: PCT/EP2016/067844
§ 371 (c)(1),
(2) Date: Jan. 25, 2018

(87) PCT Pub. No.: WO2017/017115
PCT Pub. Date: Feb. 2, 2017

(65) Prior Publication Data

US 2018/0211505 A1 Jul. 26, 2018

Related U.S. Application Data

(60) Provisional application No. 62/197,800, filed on Jul. 28, 2015, provisional application No. 62/272,124, filed on Dec. 29, 2015.

(51) Int. Cl.
*G08B 1/08* (2006.01)
*G08B 21/04* (2006.01)
(Continued)

(52) U.S. Cl.
CPC ..... *G08B 21/0446* (2013.01); *G08B 21/043* (2013.01); *G08B 25/016* (2013.01); *G08B 25/10* (2013.01)

(58) Field of Classification Search
CPC ..... G08B 21/00; G08B 21/0446
(Continued)

(56) References Cited

U.S. PATENT DOCUMENTS

2005/0212760 A1 9/2005 Marvit et al.
2006/0282021 A1* 12/2006 DeVaul ..... A61B 5/0024 600/595
(Continued)

FOREIGN PATENT DOCUMENTS

WO 2012080964 A1 6/2012

OTHER PUBLICATIONS

Philips Research Europe: "Monitoring Wearing Compliance of Emergency Help Button"; Technical Note PR-TN 2014/00283, Jun. 2014, 14 Page Document.
(Continued)

*Primary Examiner* — Tai T Nguyen

(57) ABSTRACT

In a personal emergency response system (PERS), a subscriber wears a personal help button (PHB) (10) with a call button (12). A speakerphone console (30) detects a signal transmitted by the PHB when the call button is pressed and establishes a telephone call with a PERS center (8). The PHB, speakerphone console, or combination thereof also performs a check-in process including: detecting (50) a check-in time and outputting (52) a request to perform a check-in action and detecting (54) whether the check-in action is performed. The check-in action is logged (56) if it is detected. A remedial action (60, 62, 64, 66, 68, 70, 72) is performed if the check-in action is not detected. The check-in action may be a designated motion of the PHB detected
(Continued)

by gesture recognition algorithm performed by the PHB that analyzes sensor data generated by a motion sensor (22) of the PHB.

21 Claims, 2 Drawing Sheets

(51) Int. Cl.
*G08B 25/01* (2006.01)
*G08B 25/10* (2006.01)

(58) Field of Classification Search
USPC ..... 340/539.312, 539.313, 539.32, 540, 541, 340/669
See application file for complete search history.

(56) References Cited

U.S. PATENT DOCUMENTS

2009/0160643 A1 6/2009 Lizza
2009/0322573 A1* 12/2009 Southivong ..... H03M 7/4006 341/107
2011/0045795 A1 2/2011 Sacknoff
2013/0090083 A1 4/2013 DeMont et al.
2015/0145662 A1* 5/2015 Barfield, Jr. ..... G08B 25/016 340/436
2016/0187995 A1* 6/2016 Rosewall ..... H04W 4/02 345/156
2016/0252969 A1* 9/2016 Lee ..... G06F 3/017 345/156
2017/0193806 A1* 7/2017 Graafsma ..... G01S 19/01

OTHER PUBLICATIONS

Bai et al: "Design and Implementation of Fall Detecton and Voice Response Detection in a Smart Phone"; IEEE, 2014, 5 Page Document.
Medrano et al: "Personalizable Smartphone Application for Detecting Falls"; IEEE, 2014, pp. 169-172.
Tsai et al: Gesture-Aware Fall Detection System: Design and Implementation; IEEE 5th International Conference on Consumer Electronics Berlin, 2015, pp. 88-92.

* cited by examiner

CHECK-IN SERVICE ON A PERSONAL HELP BUTTON

CROSS-REFERENCE TO PRIOR APPLICATIONS

This application is the U.S. National Phase application under 35 U.S.C. § 371 of International Application No. PCT/EP2016/067844, filed on Jul. 26, 2016 which claims the benefit of U.S. Provisional Patent Application No. 62/197,800, filed on Jul. 28, 2015 and U.S. Provisional Patent Application No. 62/272,124, filed Dec. 29, 2015 These applications are hereby incorporated by reference in their entirety herein.

FIELD

The following relates generally to the Personal Emergency Response System (PERS) arts and related arts.

BACKGROUND

A Personal Emergency Response System (PERS) enables an elderly person, handicapped person, or other person at elevated risk of accident or incapacitating medical emergency to summon help. As such systems are typically on a subscriber basis, i.e. the at-risk person subscribes to the PERS service (either on a paid basis, or with the subscription provided by a healthcare provider, governmental agency, or other sponsor). The PERS typically includes a personal help button (PHB) worn as a necklace-born pendant, or on a bracelet, or the like. By pressing the call button of the PHB, a speakerphone console in the residence is activated, by which the subscriber is placed into telephonic (or videophone, or the like) contact with a PERS agent. The agent speaks with the subscriber and takes appropriate action such as talking the subscriber through the problem, summoning emergency medical service (EMS), or alerting a neighbor or other authorized person to check on the subscriber.

As an additional safety measure, a periodic check-in can be provided to ensure against the subscriber being incapacitated and unable to press the PHB. A check-in service is typically implemented as a timer at the speakerphone console that, at check-in time, issues an instruction to the subscriber to press a button on the speakerphone console to perform the check-in. In this way, it is verified that the subscriber is physically capable of moving to the speakerphone and pressing the check-in button.

The following discloses a new and improved systems and methods that address the above referenced issues, and others.

SUMMARY

Existing check-in approaches have some disadvantages. The subscriber must get up and walk to the communicator. While this verifies subscriber mobility, it may be problematic for patients with mobility difficulties, e.g. a paraplegic patient or a patient with chronic obstructive pulmonary disease (COPD). Further, if the subscriber is not home when the instruction to press the check-in button is issued, then a check-in failure is reported. This latter disadvantage may in principle be alleviated by permitting the user to set the speakerphone into an "away" mode when out-of-residence, but the subscriber may fail to remember to set the "away" mode.

In one disclosed aspect, a device for use in conjunction with a personal emergency response system (PERS) comprises a wearable personal help button including a call button and a transmitter or transceiver (24), and a speakerphone console including a speaker and microphone. The speakerphone console is configured to detect a signal transmitted by the wearable personal help button in response to the call button being pressed and to establish a telephone call in response to detecting the signal. One of the wearable personal help button, the speakerphone console, and the combination of the wearable personal help button and the speakerphone console is configured to perform a check in process including: detecting a check-in time; in response to detecting a check-in time, outputting a human-perceptible request to perform a check-in action and detecting whether the check-in action is performed in response to the outputting; and performing a remedial action if the check-in action is not detected.

In another disclosed aspect, a wearable personal help button comprises a call button, a transmitter or transceiver, a motion sensor, and an electronic processor programmed to perform a check-in process comprising: detecting a check-in time; in response to detecting a check-in time, detecting whether a check-in action comprising a designated motion of the wearable personal help button is performed using a gesture recognition algorithm performed by the electronic processor that analyzes sensor data generated by the motion sensor to detect the designated motion; and performing a remedial action if the check-in action is not detected.

In another disclosed aspect, a check-in method comprises: detecting a check-in time; in response to detecting a check-in time, outputting a human-perceptible request to perform a check-in action using a wearable personal help button and detecting whether the check-in action is performed using the wearable personal help button in response to the outputting; and performing a remedial action if the check-in action is not detected.

One advantage resides in providing check-in that is more convenient for patients with limited mobility.

Another advantage resides in providing a check-in service that is more convenient for patients with limited mobility while still retaining effective check-in verification of the cognitive and physical capacity of the subscriber.

Another advantage resides in providing a check-in service with reduced false check-in failure reports.

Another advantage resides in providing a check-in service that is not tethered to the in-residence speakerphone console.

A given embodiment may provide none, one, two, more, or all of the foregoing advantages, and/or may provide other advantages as will become apparent to one of ordinary skill in the art upon reading and understanding the present disclosure.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION

In illustrative embodiments described herein, the at-risk person served by the illustrative Personal Emergency Response System (PERS) is referred to as a "subscriber". This recognizes that the at-risk person subscribes with the PERS service so that the subscriber's personal help button (PHB) and linked speakerphone console are associated with the service and appropriate subscriber data are stored at the PERS server and made available to a PERS agent handling a subscriber event. It is to be understood that the term "subscriber" has no further connotation—for example, any costs or fees associated with the subscription may be paid by the subscriber, or by a medical insurance company, or by a governmental agency, or by some other third party.

Terminology such as "home" or "residence" merely connotes the location where the speakerphone console assigned to a subscriber is installed. The home or residence may, by way of non-limiting example, be an individual residence, a group residence, an apartment, an assisted care facility, or so forth.

Figure 1:
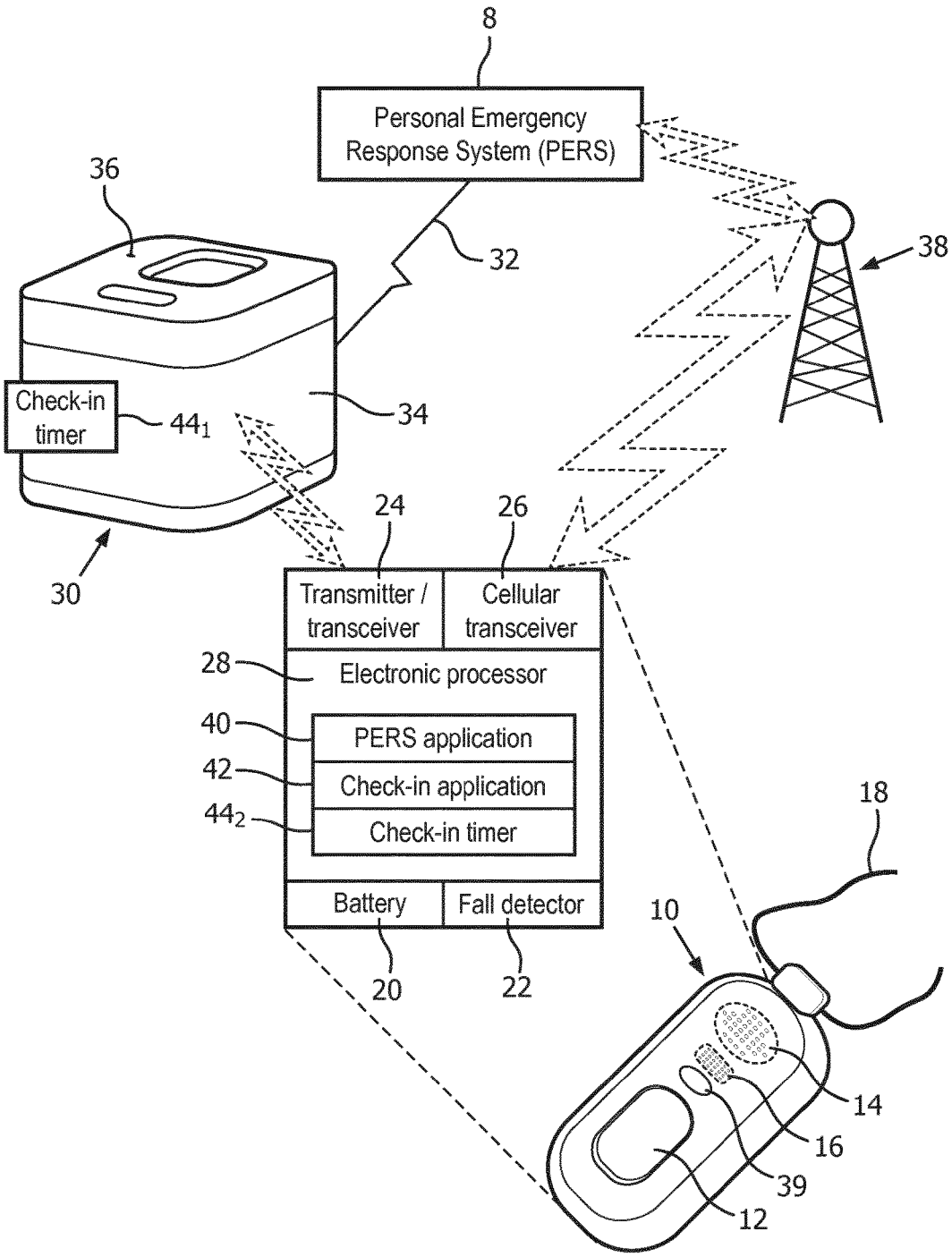
FIG. 1 diagrammatically illustrates a Personal Emergency Response System (PERS) employing a personal help button (PHB) and providing a check-in service as disclosed herein.

With reference to FIG. 1, an illustrative Personal Emergency Response System (PERS) call center 8 is diagrammatically represented. The PERS call center 8 may include, by way of illustration, a call center staffed by PERS agents each having an electronic work station including a computer on which a subscriber's profile may be displayed and telecommunication equipment such as a headset via which the agent can converse with a subscriber. FIG. 1 also represents PERS equipment assigned to a representative subscriber, including a personal help button (PHB) 10 having a call button 12 for triggering a call to the PERS center 8, and optionally other features such as a built-in speaker 14 and microphone 16. The illustrative wearable PHB 10 is a pendant that is worn around the neck via a necklace 18 (shown in part). More generally, the wearable PHB is a unitary device that can have any suitable wearable form factor, such as the illustrative necklace-worn pendant, or a bracelet or wristband mount, or so forth, and includes simple and effective mechanism such as the illustrative push button 12 for triggering a call to the PERS call center 8. The wearable PHB 10 is suitably battery-powered by a built-in rechargeable and/or replaceable battery 20 to enable complete portability. Optionally, the PHB 10 includes one or more components to automatically trigger a call to the PERS center 8 based on detection of certain condition(s). For example, the illustrative PHB 10 includes a fall detector 22 comprising an accelerometer that triggers a call to the PERS call center 8 responsive to detecting a fall event (e.g. a rapid downward acceleration and/or abrupt termination of same, indicative of a sudden fall and/or hitting the ground). Additionally or alternatively, the fall detector 22 may comprise a magnetometer or other sensor capable of producing a sensor signal indicative of a fall event. The PHB 10 optionally has other attributes such as optionally being waterproof so it can be worn in a bath or shower. Because the PHB 10 is designed to be operated by the subscriber under duress possibly including compromised physical or mental agility, it is preferably designed to minimize operational complexity and likelihood of operator error. For example, in some embodiments the wearable personal button device 10 includes only the call button 12 and no other user controls, and the call button 12 is preferably large with a tactile surface to facilitate its activation by the subscriber even if the subscriber's hand is trembling or the subscriber has vision difficulty, pain, or is otherwise debilitated.

For operation within the subscriber's residence, the PHB 10 further includes a transmitter 24 for transmitting a wireless call signal to a speakerphone console 30. In some embodiments, the PHB 10 may also include a cellular transceiver 26 via which the subscriber can communicate when out-of-residence. The speakerphone console 30 is located in the residence and is connected with the PERS call center 8 via a reliable communication link 32 such as a telephone landline, i.e. telephone line 32. The transmitter 24 has a range approximately coinciding with the spatial extent of the residence (and possibly its immediate environs, e.g. extending to encompass a neighboring house or an apartment floor above or below a residence apartment or so forth). Although the transmitter 24 preferably provides coverage for the entire residence, it is contemplated that in some instances the short range communication may fail to provide such complete coverage and there may, for example, be one or two rooms of a large house that are not covered by the local wireless link 20. The speakerphone console 30 includes a speaker 34 and a microphone 36.

In operation, the subscriber presses the call button 12 on the PHB 10 to initiate a call to the PERS call center 8, for example in response to the subscriber experiencing a medical difficulty or otherwise needing assistance. Pressing the call button 12 triggers the transmitter 24 to transmit a call signal to the speakerphone console 30, which automatically dials an appropriate telephone number to place a telephone call to the PERS center 8, where a PERS agent receives the call and speaks with the subscriber via the speakerphone capability of the speakerphone console 30 (that is, via the speaker 34 and a microphone 36). Alternatively, the speakerphone 30 may send a signal to the PERS call center 8 via the landline 32 which informs the PERS agent of the subscriber identification code (ID) of the subscriber, and the PERS agent looks up the telephone number assigned to the speakerphone 30 of the subscriber and telephones that number to initiate communication with the subscriber via the speakerphone console 30.

The speakerphone console 30 is limited to providing assistance to the subscriber when the subscriber is in-residence. Some embodiments are limited to this in-residence service, and the subscriber is unable to receive PERS assistance when away from the residence (or, more precisely, when the subscriber move the transmitter 24 out of range of the speakerphone console 30 and/or when the subscriber is too far away from the speakerphone 30 to engage in telephonic conversation using the speakerphone).

In other embodiments, the optional cellular transceiver 26 is provided to enable PERS coverage when the subscriber is out-of-residence. In a suitable approach, the transmitter 24 is replaced by a transceiver 24 that enables the PHB 10 to receive confirmation feedback from the speakerphone console 30. For example, the transceiver 24 may poll the speakerphone console 30 every few minutes, and if no confirmation response is received from the speakerphone console 30 then the PHB 10 switches to a mobile mode using the cellular transceiver 26. When in mobile mode, pressing the call button 12 causes the cellular transceiver 26 to automatically dial the appropriate telephone number to place a telephone call to the PERS center 8, e.g. via a cellular tower 38 or other cellular link. A PERS agent receives the cellular call and speaks with the subscriber via a speakerphone capability built into the PHB 10, e.g. via the illustrative optional speaker 14 and microphone 16. Alternatively, the cellular transceiver 26 may send a signal to the PERS call center 8 via the cellular network (e.g. cell tower 38) which informs the PERS agent of the subscriber identification code (ID) of the subscriber and that the call is being issued via cellular, and the PERS agent looks up the cellular telephone number assigned to the PHB 10 of the subscriber and telephones that number to initiate communication with the subscriber via the optional speakerphone 14, 16 of the PHB 10.

If the optional fall detector 22 or other automated call triggering is provided, then a PERS center call may also be initiated automatically following the above in-residence or out-of-residence process, but being initiated by a signal from the fall detector 22 (or other triggering sensor) rather than by activation of the call button 12.

To implement complex functionality, such as operating the fall detector 22 or other automatic calling mechanism, or performing call handling via the cellular transceiver 26 and speaker 14 and microphone 16, the illustrative PHB 10 includes the electronic processor 28 (e.g., a microprocessor or microcontroller) which executes a PERS application 40 to perform functions such as processing accelerometer data to detect a fall signature, polling the speakerphone console 30, placing and handling a cellular telephone call, or so forth. The electronic processor 28 also executes a check-in application 42 to perform subscriber action-based check-in as described herein.

Figure 2:
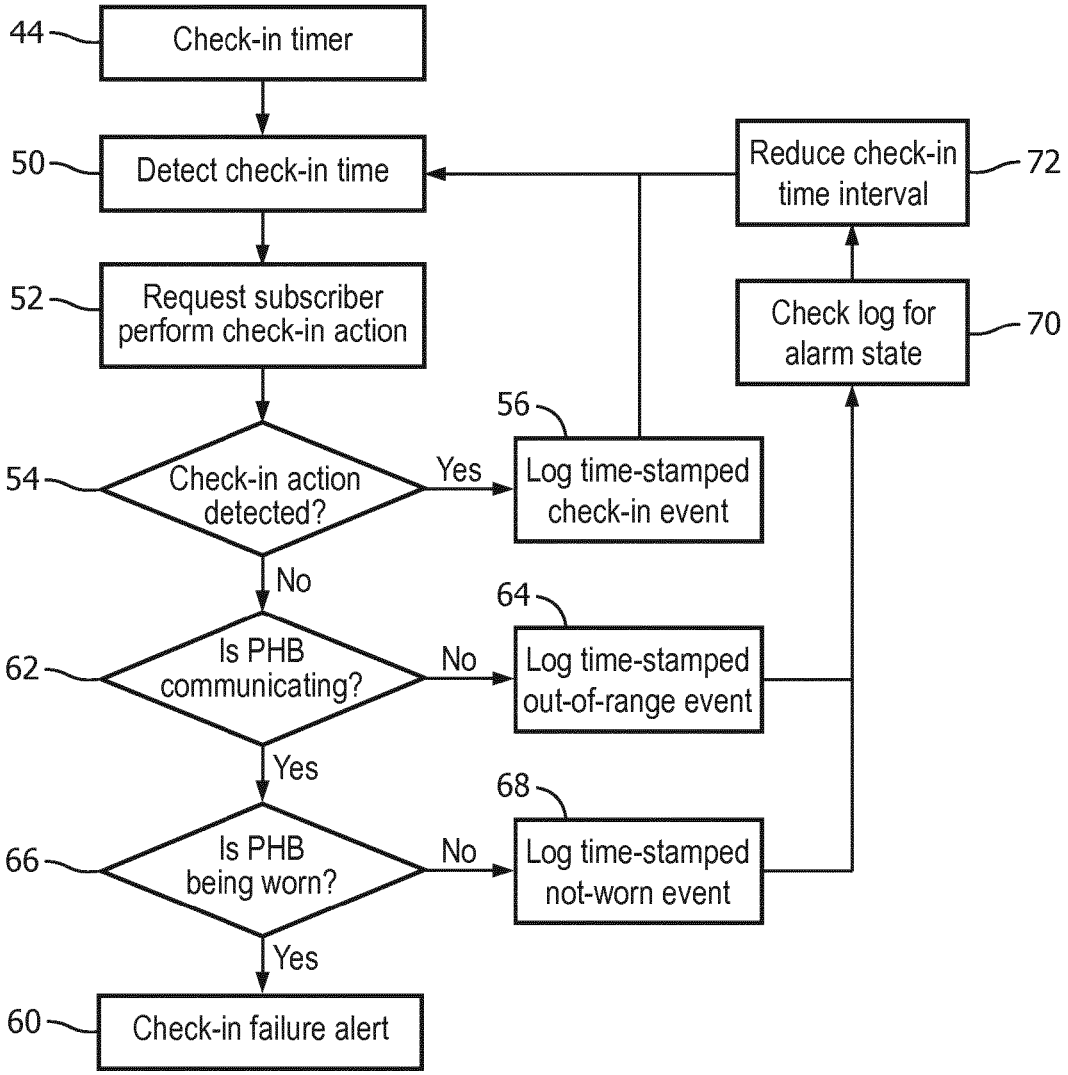
FIG. 2 diagrammatically illustrates a subscriber check-in procedure suitably performed by the PERS of FIG. 1.

With continuing reference to FIG. 1 and with further reference to FIG. 2, an illustrative check-in process performed by the PHB 10 and/or the speakerphone console 30 is described. The check-in process employs a check-in timer 44 to detect when a check-in should be performed. The check-in timer may be a check-in timer $\mathbf{44}_1$ built into the speakerphone console 30, and/or may be a check-in timer may be a check-in timer $\mathbf{44}_2$ built into the PHB 10. An advantage of using a check-in timer $\mathbf{44}_1$ built into the speakerphone console 30 is that the PERS center 8 can directly communicate with the speakerphone console 30 to adjust the check-in timer $\mathbf{44}_1$. A disadvantage is that using the speakerphone based timer $\mathbf{44}_1$ can increase load on the battery 20 of the PHB 10 if it monitors for the check-in trigger signal sent by the speakerphone console 30. Using the internal check-in timer $\mathbf{44}_2$ may use less battery power, but is less flexible in terms of external control by the PERS center 8. One approach for external adjustment of a PHB-based timer $\mathbf{44}_2$ is to have a time table loaded into the PHB 10, which can be updated when the PHB is connected to the speakerphone console 30 for other purposes. Check-ins can be set at regular intervals, e.g. every hour, every 90 min, as set times during the day (morning, afternoon, evening), once per day, or so forth. More frequent check-ins promote subscriber safety, but a too-frequent check-in setting may cause burden and annoy the subscriber.

With continuing reference to FIG. 2, in an operation 50 the check-in time is detected, and in an operation 52 the subscriber is requested to perform a check-in action. This request can be issued by the speaker 34 of the speakerphone console 30, e.g. by playing a preprogrammed voice message or signal, or can be issued by the PHB 10, e.g. using the speaker 14 if available, or by operation of a designated LED indicator 39 optionally labeled with "Please check-in" or the like (label not shown). In response to the request 52, the subscriber has been instructed to respond with a designated detectable check-in action.

The check-in action can take various forms. In some embodiments, the check-in action is a designated motion of the PHB 10 that can be detected by the motion sensor (e.g. accelerometer) of the fall detector 22. For example, the designated motion may be shaking the PHB 10 up and down, or side-to-side or in some other distinctive pattern (or, in an alternative embodiment, shaking in any direction with at least some minimum amount of effort), or tapping the PHB 10 against a hard surface such as a tabletop, or tapping the PHB 10 with a finger, e.g. requiring a double-tap to avoid false detection, or rotating the PHB 10 in a full 360° rotation or some other distinctive movement such as turning the PHB 10 upside down for a defined time then turning it back, or so forth. The chosen check-in motion in such embodiments should produce a motion sensor signal that is readily distinguished from the motion sensor signal of a fall event. The chosen check-in motion should also produce a motion sensor signal that is readily distinguished from random motions that may occur as the subscriber walks or performs other routine activities. Advantageously, in such embodiments the check-in motion detection can utilize known gesture recognition techniques commonly used in gaming console controllers and the like. A further advantage of this type of check-in action is that its performance by the subscriber verifies that the subscriber presently possesses the cognitive and physical capacity to execute the (optionally complex) motion of the PHB 10 in response to the check-in request 52. The sensing for the check-in motion is enabled or powered on only after the check-in timer 44 activates a check-in operation in operation 50 and the request for check-in issued in operation 52, and the sensing goes to sleep after the response is received in operation 54 or response time-out has passed.

In other embodiments, the check-in action may take other forms. For example, in embodiments in which the PHB 10 includes a built-in microphone 16, the check-in action can be a designated spoken word or phrase. In embodiments in which the PHB 10 does not include a built-in microphone 16 but the PERS only operates in-residence (e.g., no cellular transceiver 26), the check-in action can similarly be a designated spoken word or phrase that is detected by the microphone 36 of the speakerphone console 30. In yet other embodiments, the PHB includes a dedicated check-in button (not shown) and the check-in action is the pressing of the dedicated check-in button.

In some embodiments, it is contemplated for the check-in action to be the pressing of the help button 12. To distinguish the check-in action from the usual use of the help button 12 to call the PERS center 8, the check-in action can require the help button 12 to be pressed in a particular sequence, e.g. twice in quick succession, or thrice in quick succession. Although such embodiments are contemplated, they are generally not preferred because the check-in action can be mistaken for a call to the PERS call center 8 or vice versa, i.e. an intended call to the PERS call center 8 can be mistaken for a check-in action. Furthermore, using the help button 12 to perform the check-in action can be confusing for the subscriber, who must distinguish two different uses of the call button 12.

In decision operation 54, it is determined whether the check-in action has been performed. This determination depends upon the nature and type of the designated check-in action. For check-in actions comprising designated motion of the PHB 10, the operation 54 is suitably performed by the check-in application 42 running on the electronic processor 28 of the PHB 10 in conjunction with the motion sensor of the fall detector 22. For spoken check-in actions that are detected by the optional microphone 16 of the PHB 10, the operation 54 is suitably performed by the check-in application 42 running on the electronic processor 28 of the PHB 10 in conjunction with the microphone 16. For spoken check-in actions that are detected by the microphone 36 of the speakerphone console 30, the operation 54 is suitably performed by the speakerphone console 30.

The decision operation 54 preferably requires that the check-in action be performed within some defined timeout interval after issuance of the request 52 in order to be detected as a responsive check-in action. Put another way, the check-in detection operation 54 preferably has a "time-out" period, such that if the check-in action is not detected before the time-out period expires then the output is a decision that the check-in action was not detected. If the check-in request 52 is issued by the speakerphone console 30 while the check-in action detection 54 is performed by the PHB 10, then the transmitter or transceiver 24 of the PHB 10 should be a transceiver 24 that receives a signal from the speakerphone console 30 indicating that the check-in request 52 has been issued in order to synchronize the check-in action detection operation 54 with the check-in request 52.

If the operation 54 detects the check-in action, then in an operation 56 the check-in event is logged, preferably with a time stamp obtained from the timer 44 or from another clocking mechanism. The logging operation 56 (and, more generally, any of the event logging operations associated with the check-in process of FIG. 2) can, in general, be performed at the PHB 10, at the speakerphone console 30, or at both locations. If the check-in action detection 54 is performed at the PHB 10 and the check-in logging 56 is performed at the speakerphone console 30, then the logging includes transmission via the transmitter or transceiver 24 of the PHB 10 of a signal indicating to the speakerphone console 30 that the check-in action has been detected. On the other hand, if events are logged at the PHB 10, then they are preferably off-loaded to the speakerphone console 30 via the transmitter or transceiver 24 at some point in time when the PHB 10 is in communication with the speakerphone console 30, and/or are preferably off-loaded to the PERS center 8 via the landline connection 32 to the speakerphone console 30 or via the cellular transceiver 26. Events logged at the speakerphone console 30 are preferably off-loaded to the PERS center 8 via the landline connection 32. Event log offloading can be performed asynchronously with respect to the check-in times, that is, log offloading does not necessarily need to be performed immediately upon logging of an event.

If the decision operation 54 fails to detect the check-in action, the operations 52, 54 may optionally be repeated one or more times in further attempt(s) to elicit a successful check-in action response. It is contemplated for these repetitions to use different modalities or particularities in issuing the request 52, e.g. if an audio request is issued then the repeated audio request may be at a higher volume, or as another example if the first request is blinking the LED indicator 39 then the second request may be an audio request. Likewise, it is contemplated to modify the check-in action required to satisfy a repeated request, e.g. a less vigorous shaking of the PHB 10 may be sufficient satisfy the second request, but not the first request. If no check-in action is detected (optionally after one or more such repetitions of the sequence 52, 54), then a check-in failure alert 60 may be immediately issued. This may entail initiating an automatic call to the PERS call center 8 as already described in for a fall event (that is, the check-in failure is treated as a triggering event for an automatic call to the call center). If the PHB 10 includes an audio speaker 14, it is also contemplated to sound an alarm using this speaker 14 to hopefully attract attention of any nearby persons. Similarly, the speaker 34 on the console 30 may sound an alarm.

While it is contemplated to immediately issue the check-in failure alert upon (possibly repeated) failures of the detection operation 54 (that is, process flow in FIG. 2 going directly from the "No" output of decision block 54 to the failure alert block 60), in the illustrative embodiment some additional verification operations are performed prior to issuing the check-in failure alert 60, so as to reduce the likelihood/prevalence of false check-in failure alarms. In another variant embodiment, an initial alert (not shown) may be issued immediately following check-in failure at the operation 54, with the check-in failure alert 60 being issued as a follow-up alert if the additional verifications also fail.

To this end, in the illustrative check-in process of FIG. 2 the first verification operation is a communication verification check 62. If the check-in request was performed via the transceiver 24, then the communication verification check 62 can be performed by polling the speakerphone console 30 and detecting a confirmation response from the speakerphone console 30. This assumes the check-in is being logged at the PHB 10; if the check-in is being logged at the speakerphone console 30 then the polling is reversed, i.e. the speakerphone polls the PHB and receives a confirmation response from the PHB.

If the check-in is being logged at the PHB 10 in an out-of-residence mode with communication being via the cellular transceiver 26, then all operations 50, 52, 54 are performed at the PHB 10 and the communication check 62 is suitably omitted, since there is no communication link whose failure could have caused the check-in failure.

If the communication verification test 62 fails, then the failure to detect the check-in action may be due to a failure of communication rather than due to a failure of the subscriber to receive the check-in request 52 and perform the check-in action. In this case, in an operation 64 an out-of-range event is logged, preferably with a time stamp.

In the illustrative check-in process of FIG. 2, a further verification check is a check 66 as to whether the PHB 10 is being worn by the subscriber. This check can entail detecting whether the PHB 10 is stationary for an extended time period (if so, it may be sitting on a tabletop rather than being worn by the subscriber) or, if a heat sensor is included in the PHB 10 (not shown), the check 66 can detect temperature under the expectation that a worn PHB will be elevated due to heat transfer from the subscriber. (This approach assumes the PHB 10 employs low-power electronics such that the body temperature is detectable over any temperature elevation due to heat dissipation of the electronics). This temperature sensor approach is most appropriate if the PHB 10 is worn close to the body or under clothing. If the check 66 fails thereby indicating the PHB 10 is not being worn, then a "non-worn" event is logged, preferably with time stamp, in an operation 68.

It will be appreciated that the verification checks 62, 66 can be performed in reverse order versus what is illustrated in FIG. 2. Additionally, other checks are contemplated—for example, if the check-in action is detected by the motion sensor of the fall detector 22 then an additional or alternative verification check can determine whether the motion sensor is operational, e.g. by checking for a short-circuit or open-circuit failure mode of the motion sensor as appropriate for the particular motion sensor electrical configuration.

If any of the verification checks 62, 66 fail, then there is a possibility, and perhaps even a high likelihood, that the failure to detect the check-in action in decision 54 was due to a communication failure, or due to the PHB 10 not being worn, or due to a motion sensor failure, etc. In such cases, the check-in failure alert 60 is not activated. However, in some embodiments a log check operation 70 is performed to determine whether the logged events should trigger an alarm. For instance, if the last N check-ins (where N is a configurable parameter) indicated the PHB 10 is not being worn, then an alarm may be issued to trigger a (possibly manual) check to make sure the subscriber has not become incapacitated while not wearing the PHB 10, and/or to trigger follow-up to ensure compliance of the subscriber with wearing the PHB. Similarly, if the last N check-ins have resulted in logged out-of-range events then follow-up may be performed to assess operability of the subscriber's PERS hardware 10, 30. Another remedial action that may be taken is to reduce the time interval between check-ins in an operation 72.

On the other hand, if all verification checks 62, 66 are passed (and optionally other checks that might be incorporated, such as a battery status check), then failure to detect the check-in action in the (possibly repeated) detection operation 54 is reasonably ascribed to incapacity of the subscriber to perform the check-in action. In this case, the already-described check-in failure alert 60 is executed to initiate an emergency call to the PERS center 8, issue a local alarm using the speaker(s) 14, 34, and/or take other remedial action such as issuing a telephone call to 911 or some other emergency service.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A device for use in conjunction with a personal emergency response system (PERS), the device comprising:

a wearable personal help button including a first processor, a call button and a transmitter or transceiver; and a speakerphone console including a second processor, a speaker and a microphone, the speakerphone console configured to detect a signal transmitted by the wearable personal help button in response to the call button being pressed and to establish a telephone call in response to detecting the signal;

wherein one of the first processor of the wearable personal help button, the second processor of the speakerphone console, and a combination of the first processor of the wearable personal help button and the second processor of the speakerphone console is configured to perform a check in process including:

detecting a check in time;

in response to detecting a check in time, outputting a human-perceptible request to perform a check in action and detecting whether the check in action is performed in response to the outputting; and performing a remedial action if the check in action is not detected, including performing one or more verification checks and issuing a check in failure alert only if each of the one or more verification checks are passed.

2. The device of claim 1 wherein the wearable personal help button includes an electronic processor and a motion sensor, and detecting whether the check in action is performed comprises:

detecting whether the check in action comprising a designated motion of the wearable personal help button is performed using a gesture recognition algorithm performed by the electronic processor that analyzes sensor data generated by the motion sensor to detect the designated motion.

3. The device of claim 2 wherein the designated motion of the wearable personal help button comprises shaking the wearable personal help button, tapping the wearable personal help button against a hard surface, or rotating the wearable personal help button.

4. The device of claim 1 wherein detecting whether the check in action is performed comprises:

detecting whether the check in action comprising speaking a designated word or phrase is performed using the microphone of the speakerphone console.

5. The device of claim 1 wherein the check in action does not include pressing the call button of the wearable personal help button and detecting whether the check in action is performed does not include detecting whether the call button of the wearable personal help button is pressed.

6. The device of claim 1 wherein the outputting comprises:

playing a pre-recorded audio request to perform the check in action using the speaker of the speakerphone console.

7. The device of claim 1 wherein the outputting comprises:

illuminating an LED indicator of the wearable personal help button.

8. The device of claim 1 wherein the one or more verification checks include a verification check that the wearable personal help button has an operational communication link with the speakerphone console.

9. The device of claim 1 wherein the one or more verification checks include a verification check that the wearable personal help button is being worn by an associated subscriber.

10. The device of claim 1 wherein:

the speakerphone console performs the operation of detecting a check in time;

the wearable personal help button performs the operation of detecting whether the check-in action is performed; and the check in process further includes transmitting a signal indicating detection of a check in time from the speakerphone console to the wearable personal help button via the transceiver.

11. A wearable personal help button comprising:

a call button;

a transmitter or transceiver;

a motion sensor; and an electronic processor programmed to perform a check in process comprising:

detecting a check in time;

in response to detecting a check in time, detecting whether a check in action comprising a designated motion of the wearable personal help button is performed using a gesture recognition algorithm performed by the electronic processor that analyzes sensor data generated by the motion sensor to detect the designated motion; and performing a remedial action if the check in action is not detected, including performing one or more verification checks and issuing a check in failure alert only if each of the one or more verification checks are passed.

12. The wearable personal help button of claim 11 wherein the designated motion of the wearable personal help button comprises shaking the wearable personal help button, tapping the wearable personal help button against a hard surface, or rotating the wearable personal help button.

13. The wearable personal help button of claim 11 wherein detecting the check in time comprises:

detecting a wireless signal indicating a check in time using transceiver.

14. The wearable personal help button of claim 11 wherein detecting the check in time comprises:

detecting a check in time using a timer of the wearable personal help button.

15. The wearable personal help button of claim 11 further comprising:

an output component comprising a speaker or an LED indicator;

wherein the check in process further includes, in response to detecting a check in time, outputting a request to perform the check in action using the output component.

16. The wearable personal help button of claim 11 wherein the one or more verification checks includes:

performing at least one of:

a verification check that the wearable personal help button has an operational communication link via the transceiver, and a verification check that the wearable personal help button is being worn by an associated subscriber.

17. The wearable personal help button of claim 11 wherein the wearable personal help button is a pendant on a necklace or a bracelet.

18. A check in method comprising:

detecting a check in time;

in response to detecting a check in time, outputting a human-perceptible request to perform a check in action using a wearable personal help button and detecting whether the check in action is performed using the wearable personal help button in response to the outputting; and performing a remedial action if the check in action is not detected, including performing one or more verification checks and issuing a check in failure alert only if each of the one or more verification checks are passed.

19. The method of claim 18 wherein the check in action is a designated motion of the wearable personal help button.

20. The method of claim 19 wherein the designated motion of the wearable personal help button comprises one of shaking the wearable personal help button, tapping the wearable personal help button against a hard surface, and rotating the wearable personal help button.

21. The method of claim 18 wherein the one or more verification checks includes:

performing at least one of:

a verification check that the wearable personal help button has an operational communication link via the transceiver, and a verification check that the wearable personal help button is being worn by an associated subscriber.

* * * * *